United States Patent [19]

Imamura

[11] Patent Number: 4,710,423

[45] Date of Patent: Dec. 1, 1987

[54] WOVEN POLYESTER WEBBING FOR SAFETY BELTS

[75] Inventor: Tosuke Imamura, Nara, Japan

[73] Assignee: Teijin Limited, Osaka, Japan

[21] Appl. No.: 929,638

[22] Filed: Nov. 10, 1986

[30] Foreign Application Priority Data

Nov. 11, 1985 [JP] Japan ..... 60-250639

[51] Int. Cl.[4] ..... D03D 15/00

[52] U.S. Cl. ..... 428/272; 139/420 A; 428/265

[58] Field of Search ..... 428/265, 272; 139/383 R, 420 A

[56] References Cited

U.S. PATENT DOCUMENTS 4,386,943 6/1983 Gümbel et al. ..... 428/272

4,388,364 6/1983 Sanders ..... 428/272

*Primary Examiner*—Marion C. McCamish

*Attorney, Agent, or Firm*—Kenyon & Kenyon

[57] ABSTRACT

A webbing useful for safety belts having an excellent impact energy absorption and a superior impact strength, comprises a webbing made by weaving warps and wefts, at least the warps consisting of polyester filaments which have an intrinsic viscosity of 0.7 or more, a birefringence of 0.08 to 0.15, a tensile strength of 4 g/denier or more, an ultimate elongation of from 50% to 80%, and an elongation value of 5% or less at a point A in a stress-strain curve of the filaments, which point A denotes an intersection point of an extension of a steeply sloped portion of the curve appearing at the initial stage of the elongation of the filaments with an extension of a substantially horizontal or gently sloped portion of the curve appearing at the middle stage of the elongation of the filaments.

5 Claims, 2 Drawing Figures

WOVEN POLYESTER WEBBING FOR SAFETY BELTS

BACKGROUND OF THE INVENTION (1) Field of the Invention

The present invention relates to a webbing useful for safety belts. Particularly, the present invention relates to a webbing having an excellent impact energy absorption and a superior impact strength and useful for safety belts for cars and aircraft.

(2) Description of the Related Art

It is known that webbing to be used for safety belts for cars and aircraft is required to have a satisfactory absorption or mitigation of the impact force applied to a human body upon collision, and a satisfactory light weight, durability, color, pattern, design, and shape.

It is also known, however, that it is difficult to produce a webbing for safety belts having such a satisfactory impact force-absorption or mitigation property.

Several attempts to enhance the impact force-absorption or the webbing have been disclosed. For example, Japanese Examined Patent Publication (Kokoku) No. 53-1874 discloses a dynamic energy absorption belt in which two different types of yarns are used as warps and at least one type of the warp yarns is arranged in such a manner that the crimp percentage of the warp yarns increases with an increase in the distance from each side edge of the belt.

Japanese Examined Patent Publication (Kokoku) No. 53-2981 discloses a webbing for safety belts, having warps comprising high elongation filament yarns and low elongation filament yarns which are distributed among the high elongation filament yarns, and each of which low elongation filament yarns consists of first high tensile strength, low elongation filaments and second low tensile strength, low elongation filaments, the first high tensile strength, low elongation filaments being incorporated in a looped state with the second low tensile strength, low elongation filaments.

Japanese Examined Patent Publication (Kokoku) No. 54-19511 discloses a dynamic energy-absorption belt characterized in that two types of yarns having a different elongation from each other are used as warps, and that in the warps, at least one type of yarns, which are broken before the belt is ultimately broken, consists of at least two types of yarns having a different crimp percentage from each other.

Japanese Examined Patent Publication (Kokoku) No. 55-11053 discloses an energy-absorbing belt characterized in that two or more types of yarns consisting of the same type of polymer and having a different ultimate (breaking) elongation and initial elastic modulus, the ultimate elongation decreasing with an increase in the initial elastic modulus and the ultimate elongation increasing with a decrease in the initial elastic modulus, are used as warps, and in the weave structure of the belt, the crimp percentage of the warps is adjusted so that the crimp percentage decreases with a decrease in the ultimate elongation and increases with an increase in the ultimate elongation, and that the weave structure contains pores in a total volume of 40% or less. Also, Japanese Publication No. 55-11053 discloses a process for producing the energy-absorbing belt characterized in that a woven belt is produced from two or more different types of yarns capable of thermally shrinking, which yarns have been imparted with different crimp percentages, and the resultant woven belt is heat treated under tension.

The above-mentioned known dynamic energy-absorbing belts are intended to enhance the impact energy absorption property thereof by utilizing warps consisting of two or more types of yarns having a different tensile strength, elongation, and/or crimp percentage from each other.

According to the results of tests effected by the inventors of the present invention for the above mentioned types of energy-absorbing belts, it was concluded that the energy absorption by the above-mentioned types of belts is carried out stepwise, not continuously and smoothly.

It is true that the above-mentioned types of belts effectively decrease a sudden shock received by a human body, but the two or more different types of warps separately absorb the impact energy stepwise. Therefore, after one type of warps absorbs a portion of the impact energy, and before another type of warps absorbs another portion of the impact energy, the human body is exposed to an undesirable shock.

In order to eliminate the above-mentioned problem, Japanese Unexamined Patent Publication (Kokai) No. 59-179842 disclosed a webbing for safety belts comprising a woven belt which is characterized in that the warps consist of polyester filament yarn having an intrinsic viscosity of 0.7 or more; a birefringence of 0.03 to 0.13; an initial Young's modulus of 20 g/denier or more; an ultimate elongation of 80 to 200%; an elongation value of 5% or less at a point A in the tensile stress-strain curve of the yarns, which point A denotes an intersecting point of an extension line of a steeply sloped portion of the curve appearing in the initial stage of elongation of the yarns with an extension line of a substantially horizontal or slightly sloped portion of the curve appearing at the middle stage of elongation of the yarns; an elongation value of 30 to 60% at a point B in the curve, which point B denotes an intersecting point of the substantially horizontal or slightly sloped portion of the curve appearing in the middle stage of elongation of the yarns with a gently sloped portion of the curve appearing in the final stage of elongation of the yarns; and a ratio of the tensile strength of the yarns at a point C in the curve, which point C denotes a final end point of the curve, to that at the point A, of 1.5 or more.

This type of webbing exhibits a satisfactory impact energy absorption. It was found, however, that this type of webbing sometimes has an unsatisfactory tensile strength. Also, it was found that the polyester filament yarns having a birefringence of 0.03 to 0.13, an ultimate elongation of 80% or more, an elongation of 5% or less at the point A, an elongation of 30 to 60% at the point B, and a ratio (C/A) or 1.5 or more, usually exhibit a very poor tensile strength. Therefore, the resultant safety belt has an unsatisfactory tensile strength and is sometimes broken upon collision. That is, when a large load of 800 to 1000 kg is abruptly applied, the safety belt is suddenly prolonged to a large elongation, and is then broken.

Under the above-mentioned circumstances, a strong demand has arisen for a new type of webbing for safety belts having warps consisting of a single type of yarn and having a satisfactory impact energy absorption and an excellent resistance against breakage by impact stretching.

SUMMARY OF THE INVENTION

An object of the present invention is to provide a webbing for safety belts having an excellent impact energy absorption upon collision.

Another object of the present invention is to provide a webbing for safety belts having a superior resistance to breakage thereof upon collision.

The above-mentioned objects can be attained by the webbing for safety belts of the present invention, which comprises a woven belt composed of warps and wefts and characterized in that at least the warps consist of polyester filament yarns having an intrinsic viscosity of 0.7 or more, a birefringence of from 0.08 to 0.15, a tensile strength of 4 g/denier or more, an ultimate elongation of from 50% to 80%, and an elongation of 5% or less at a point A in a tensile stress-strain curve of the yarns, which point A denotes an intersecting point of an extension line from a steeply sloped portion of the curve appearing in the initial stage of elongation of the yarns with an extension line from a substantially horizontal or slightly sloped portion of the curve appearing in the middle stage of the elongation of the yarns.

DESCRIPTION OF THE PREFERRED EMBODIMENTS

The polyester filament yarns usable as warps of the webbing of the present invention must consist of a polyester polymer having an intrinsic viscosity of 0.7 or more determined in a concentration of 1.2 g/100 ml in θ-chlorophenol at a temperature of 35° C. If the intrinsic viscosity is less than 0.7, the resultant polyester filament warp yarns will exhibit an unsatisfactory impact energy absorption.

The polyester filament yarns must have a birefringence (Δn) in the range of from 0.08 to 0.15. If the birefringence (Δn) falls outside of the above-mentioned range, the resultant polyester filament yarn will exhibit an unsatisfactory impact energy absorption.

The polyester filament yarns must have a tensile strength of 4 g/denier or more and an ultimate elongation of from 50 to 80%.

If the tensile strength is less than 4 g/denier, the resultant webbing is sometimes broken upon collision. If the ultimate elongation is less than 50%, a user is subjected to a strong shock and is sometimes damaged by the safety belt upon collision.

If the ultimate elongation is more than 80%, the polyester filament yarns usually will exhibit an unsatisfactory tensile strength and the resultant webbing will exhibit an unsatisfactory impact energy absorption.

Figure 1:
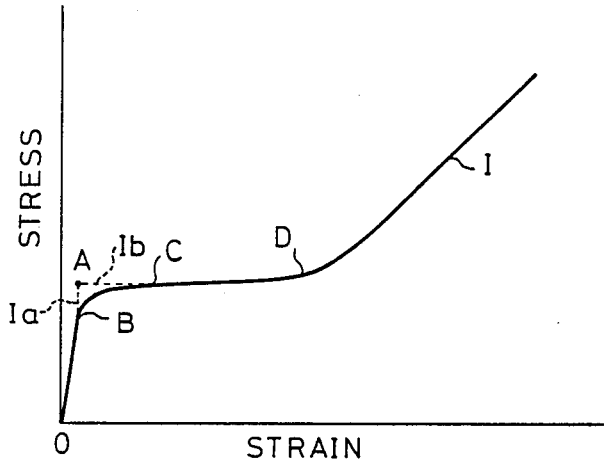
FIG. 1 shows a tensile stress-strain curve of a polyester filament yarn usable for the present invention; and, FIG. 2 shows an energy absorption of a polyester filament yarn usable for the present invention when a load is applied to and then removed from the yarn.

Referring to FIG. 1, the polyester filament yarns usable for the present invention must exhibit an elongation of 5% or less at the point A in the tensile stress-strain curve I. This point A denotes an intersecting point of an extension line Ia from a steeply sloped portion OB of the curve I, which portion OB appears in the initial stage of the elongation of the yarn, with an extension line Ib from a substantially horizonal or slightly sloped portion CD of the curve I, which portion CD appears in the middle stage of the elongation of the yarn. If the elongation of the yarn at the point A is more than 5%, the resultant webbing will exhibit an unsatisfactory impact energy absorption and tensile strength.

Usually, in the webbing of the present invention, the polyester filament warp yarns are in a warp density of 320 to 400 yarns/50 mm and each yarn has a total denier of 1,000 to 1,500 and an individual filament denier of 3 to 10.

The wefts in the webbing of the present invention may consist of ordinary polyester filament yarns in a weft density of 15 to 25 yarns/2.54 cm. Each weft yarn preferably has a total denier of 500 to 750 and an individual filament denier of 4 to 11. The ordinary polyester filament yarns have, for example, an intrinsic viscosity of 0.6, an birefringence of 0.17, a tensile strength of 5.4 g/denier, and an ultimate elongation of 32%. The wefts may consist of the same polyester filament yarns as those in the warps.

The safety belts consisting of the webbing of the present invention is useful for a two point or three point type user-restricting safety device with an ELR (Emergency Locking Retractor).

The present invention will be further explained by way of specific examples, which, however, are representative and do not restrict the scope of the present invention in any way.

EXAMPLE 1

A woven belt was produced from warps at a warp density of 360 yarns/51 mm consisting of polyethylene terephthalate multifilament yarns having a total denier of 1500 and a twist number of about 70 turns/m and consisting of 480 individual filaments having an intrinsic viscosity of 0.85, a birefringence of 0.10, a tensile strength of 4.7 g/denier, an ultimate elongation of 70%, and an elongation of 25% at the point A in the tensile stress-strain curve of the yarn, and wefts at a weft density of 19 yarns/25.4 mm, consisting of parallel yarns each of which consisted of two polyethylene terephthalate multifilament yarns having a yarn count of 630 denier/72 filaments, the filaments having an intrinsic viscosity of 0.62, a birefringence of 0.16, a tensile strength of 7.0 g/d, and an ultimate elongation of 20%.

The resultant woven belt was scoured in an ordinary manner and was dyed in such a manner that the scoured belt was impregnated with an aqueous dyeing liquid having the following composition:

| | | |
|---|---|---|
| Dianix E Blue (Trademark, made by Mitsubishi Chemical) | | 100 g/l |
| Disper TL (Trademark, made by Meisei Chemical) | | 1 g/l |
| Sodium alginate | | 0.5 g/l |
| Acetic Acid | Used to adjust the pH of the dyeing liquid to a value of 4.0 | |

was dried, and then dry heated at a temperature of 250° C. for one minute.

After washing with water, the belt was impregnated with an aqueous dispersion containing Bondic 1620 (Trademark of a 10% by weight aqueous dispersion of a polyester-polyurethane resin, made by Nippon Leichfold Co.) by a dipping-squeezing operation, was dried, and was finally heat-treated at a temperature of 180° C. for 2 minutes. Thus, a webbing for safety belts having a width of 49 mm was obtained.

The webbing exhibited the properties as shown in Table 1.

In Table 1, the amount of the energy absorption of the webbing was determined in the following manner.

A middle portion of a specimen of the belt, having a length of 200 mm under an initial tensile load of 20 kg, was stretched by increasing the tensile load to a level of 1130 kg, and upon reaching the level of 1130 kg, the tensile load was immediately and rapidly decreased to a level of 20 kg, to allow the belt to shrink.

Figure 2:
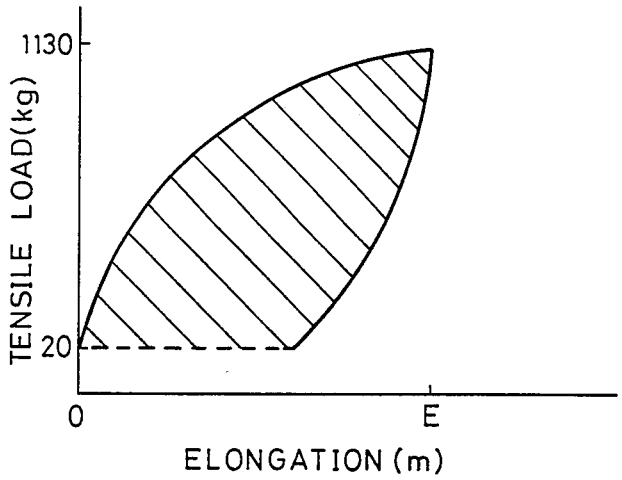

During the above-mentioned test procedures, a tensile stress-strain and recovery curve for the webbing specimen was recorded in a chart as shown in FIG. 2. The area surrounded by the stress-strain and recovery curve, that is, the area of the hatched portion in FIG. 2, was measured. Referring to FIG. 2, the value of the hatched area was divided by a value of elongation generated in the webbing by increasing the tensile load from 20 kg to 1130 kg, and the resultant quotient was increased fivefold. The resultant value was used to represent the amount of the energy absorption per meter of the webbing.

When a car collides at a speed of 40 miles/hour (about 60 km/hour), an average impact energy to which a person in the car is subjected is about 300 kgf·m to about 400 kgf·m. If almost all of the impact energy is absorbed by the safety belt, the person in the car is prevented from crashing against a handle or car panel, and thus if such a crash occurs, the damage to the person is small.

Usually, the webbing for safety belts preferably has an elongation of 30% to 40% under a tensile load of 1130 kg. Also, according to the Advanced Safety Car-Occupant Restraint System and Japanese Industrial Standard (JIS) D 4604, the webbing to be used as safety belts must have a tensile strength of 1810 kg or more.

Furthermore, the webbing for safety belts preferably has a thickness of 1.30 mm or less. A thickness of more than 1.30 mm will necessiate the use of very large ELR in the three point type safety belt equipment.

The wefts in the safety belt should not be ruptured upon absorbing an impact energy. If the wefts are ruptured, the warps cannot sufficiently exhibit a desired resistance to the impact force applied to the safety belt. Also, weak wefts in the safety belt weaken the seam strength of the belt.

Table 1 clearly shows that the webbing of Example 1 is extremely satisfactory for use as a safety belt.

COMPARATIVE EXAMPLES 1 TO 5

In each of Comparative Examples 1 to 5, the same procedures as those described in Example 1 were carried out except that the warps consisted of the polyethylene terephthalate multifilament yarns having the properties as shown in Table 1.

The properties of the comparative webbing are shown in Table 1.

TABLE 1

| Examples No. | | Item: Properties of warp polyethylene terephthalate filaments: Intrinsic viscosity [η] | Birefringence (Δn) | Ultimate elongation (%) | Elongation at point A (%) | Tensile strength (g/d) | Properties of webbing: Tensile load at 5% elongation (kg) | Elongation under 1130 kg tensile load (%) | Impact energy absorption (kgf · m) | Tensile strength (kg) | Damage to user upon collision |
|---|---|---|---|---|---|---|---|---|---|---|---|
| Example | 1 | 0.85 | 0.10 | 70 | 2.5 | 4.7 | 750 | 34 | 450 | 2100 | No |
| Comparative | 1 | 0.60 | 0.09 | 110 | 2 | 3.0 | 640 | 70 | 210 | 1370 | Yes |
| Example | 2 | 0.84 | 0.04 | 180 | 3 | 2.5 | 360 | 170 | 700 | 1200 | Yes |
| | 3 | 0.87 | 0.15 | 12 | — | — | 940 | 7 | 90 | 3600 | Yes |
| | 4 | 0.84 | 0.09 | 110 | 7 | 2.8 | 350 | 105 | 370 | 1150 | Yes |
| | 5 | 0.84 | 0.09 | 110 | 2 | 3.5 | 700 | 70 | 480 | 1450 | No |

COMPARATIVE EXAMPLES 6 TO 8

In each of Comparative Examples 6 and 7, the same procedures as those described in Comparative Example 1 were carried out except that the total deniers of the warps and the wefts, and the total number of the warps, were as shown in Table 2.

In Comparative Example 8, the same procedures as those described in Comparative Example 3 were carried out except that the total deniers of the warps and wefts, and the total number of the wefts, were as shown in Table 2.

The properties of the resultant webbings are shown, in comparison with those of Example 1, in Table 2.

TABLE 2

| Example No. | | Item: Structure of webbing: Total denier of warp (d) | Total number of warps | Total denier of weft | Properties of webbing: Thickness (mm) | Tensile strength (kg) | Rupture of wefts upon breakage of webbing |
|---|---|---|---|---|---|---|---|
| Example | 1 | 1500 | 360 | 630 | 1.28 | 2100 | No |
| Comparative | 6 | 1000 | 310 | 630 | 1.18 | 1200 | No |
| Example | 7 | 1500 | 400 | 630 | 1.40 | 2300 | No |
| | 8 | 1500 | 360 | 250 | 1.20 | 1700 | Yes |

I claim:

1. A webbing useful for safety belts comprising a woven belt composed of warps and wefts, and characterized in that at least the warps consist of polyester filament yarns having an intrinsic viscosity of 0.7 or more, a birefringence of from 0.08 to 0.15, a tensile strength of 4 g/denier or more, an ultimate elongation of from 50% to 80% and an elongation of 5% or less at a point A in a tensile stress-strain curve of the yarns, which point A denotes an intersecting point of an extension line from a steeply sloped portion of the curve appearing at an initial stage of the elongation of the yarns with an extension line from a substantially horizontal or slightly sloped portion of the curve appearing at an middle stage of the elongation of the yarns.

2. The webbing as claimed in claim 1, wherein the warps are in a warp density of 320 to 400 yarns/50 mm and each have a yarn denier of 1,000 to 1,500, and the wefts are in a weft density of 15 to 25 yarns/2.54 cm and each have a yarn denier of 500 to 750.

3. The webbing as claimed in claim 1, wherein the wefts consist of ordinary polyester filaments.

4. The webbing as claimed in claim 1, wherein the wefts consist of the same polyester filaments as those of the warps.

5. A safety belt comprising the webbing as claimed in claim 1, the webbing having been dyed and finished with a resinous finishing agent.

* * * * *